US011193648B2

(12) United States Patent
Kessels

(10) Patent No.: US 11,193,648 B2
(45) Date of Patent: Dec. 7, 2021

(54) LIGHT EMITTING DEVICE

(71) Applicant: LUMILEDS LLC, San Jose, CA (US)

(72) Inventor: Marcus Jozef Henricus Kessels, Echt (NL)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 16/909,277

(22) Filed: Jun. 23, 2020

(65) Prior Publication Data

US 2021/0003264 A1 Jan. 7, 2021

(30) Foreign Application Priority Data

Jul. 1, 2019 (EP) ..... 19183542

(51) Int. Cl.

| | |
|---|---|
| ***F21S 45/60*** | (2018.01) |
| ***F21S 41/30*** | (2018.01) |
| ***F21S 45/43*** | (2018.01) |
| ***F21S 41/13*** | (2018.01) |
| ***F21S 41/162*** | (2018.01) |
| ***F21S 41/148*** | (2018.01) |
| ***H05B 45/395*** | (2020.01) |
| ***H05B 45/14*** | (2020.01) |
| ***H05B 47/105*** | (2020.01) |

(Continued)

(52) U.S. Cl.

CPC ..... *F21S 45/60* (2018.01); *F21S 41/13* (2018.01); *F21S 41/148* (2018.01); *F21S 41/162* (2018.01); *F21S 41/30* (2018.01); *F21S 45/43* (2018.01); *H05B 45/14* (2020.01); *H05B 45/395* (2020.01); *H05B 47/105* (2020.01); *F21Y 2113/13* (2016.08); *F21Y 2115/00* (2016.08)

(58) Field of Classification Search

CPC ..... F21S 45/60; F21S 41/30; F21S 41/13

See application file for complete search history.

(56) References Cited

U.S. PATENT DOCUMENTS

2008/0265789 A1 10/2008 Bertram et al.
2012/0019145 A1 1/2012 Lai (Continued)

FOREIGN PATENT DOCUMENTS

JP 2008021602 A 1/2008
KR 20110029062 A 3/2011

(Continued)

OTHER PUBLICATIONS

English machine translation of Tokunaga EP 2008021602, published Jan. 2008 (Year: 2008).*

(Continued)

*Primary Examiner* — Evan P Dzierzynski

(57) ABSTRACT

A light emitting device is provided comprising:

a body;

a base portion configured for mounting the light emitting device to a reflector of a headlight or taillight, the base portion being arranged at a first end portion of the body;

at least one light-emitting diode arranged at or inside of the body;

at least one infrared light source provided at the body and configured to emit infrared light; and a thermal barrier arranged in between the at least one infrared light source and the at least one LED and configured to block at least part of radiation emitted from the at least one infrared light source towards the at least one LED.

15 Claims, 2 Drawing Sheets

(51) Int. Cl.
*F21Y 113/13* (2016.01)
*F21Y 115/00* (2016.01)

(56) References Cited

U.S. PATENT DOCUMENTS

| | | | | |
|---|---|---|---|---|
| 2013/0265793 | A1 | 10/2013 | Helbig et al. | |
| 2014/0328079 | A1* | 11/2014 | Itagaki | F21V 29/60 362/547 |
| 2016/0319999 | A1* | 11/2016 | Elzinga | H01L 33/62 |
| 2018/0139810 | A1* | 5/2018 | Roberts | H05B 45/10 |

FOREIGN PATENT DOCUMENTS

| | | | |
|---|---|---|---|
| WO | 2006/097863 | A1 | 9/2006 |
| WO | 2020048676 | A1 | 3/2020 |

OTHER PUBLICATIONS

From the EPO as the ISA, "Notification of Transmittal of the International Search Report and the Written Opinion of the International Searching Authority", PCT/EP2020/066895, dated Aug. 5, 2020, 13 pages.
The extended European search report corresponding to EP application No. 19183542.0, dated Sep. 30, 2019, 7 pages.
European Search Report corresponding to EP19183542.0, dated Sep. 20, 2019, 2 pages.

* cited by examiner

LIGHT EMITTING DEVICE

CROSS REFERENCE TO RELATED APPLICATIONS

This patent application claims benefit of priority to European Patent Application 19183542.0 filed Jul. 1, 2019, which is incorporated by reference herein in its entirety.

FIELD OF THE INVENTION

The present disclosure relates to a light emitting device, e.g. to a lamp, in particular to be used in the area of automotive head or tail lighting.

BACKGROUND OF THE INVENTION

Conventional automotive headlights often use halogen lamps as light sources. Halogen lamps usually comprise a gas filled envelope or bulb, for example comprising quartz glass, and one or two filaments arranged inside of the bulb. One of the filaments may serve as light source for low beam light and the other filament may serve as light source for high beam light. The bulb may be connected at one side to a base with which the halogen lamp can be inserted into and connected to a reflector of the headlight. In mounted condition, the arrangement of reflector, light bulb and base may be so dimensioned that the one or two filaments are located within a defined area in the reflector, e.g. at or close to a focal point of the reflector, so that light emitted from the one or two filaments is emitted via the reflector from the reflector opening in a defined way. Usually, the reflector opening is covered by a headlight glass which may serve as lens and/or diffusing element for shaping the emitted light (in direction and appearance). Examples of halogen lamps used in the automotive field include in particular H4 and H7 lamps defined in accordance with ECE regulations. An example of a H7 halogen lamp is disclosed in WO 2006/097863 A1.

When outdoor temperatures fall, for example in fall time or winter time, depending on the time of day, dew or even ice may form on glass surfaces covering headlights e.g. of cars. When conventional halogen bulbs are used in headlights, dew or ice may be removed automatically when the lights are turned on, as these lamps produce a lot of waste heat transferred by conductive and convective heat transfer to the cover glass as well as produce heat radiation (infrared light) in addition to visible light, this all causing dew to be removed and ice to be melted. This mechanism may no longer be available when light-emitting diodes (LEDs) are used as light sources for automotive head lights. LEDs are much more efficient than halogen lamps, thus, produce less waste heat, and, also, light emitted from LEDs within wavelength ranges for automotive head light applications typically lacks infrared components. Therefore, when LEDs are used as light sources for automotive headlights, defogging (removal of dew) and/or deicing has to be achieved by different means.

Further, while use of LEDs as light sources for automotive head light applications is advantageous from a variety of viewpoints, a power consumption of LED lights that typically is much lower than a power consumption of halogen lights may cause safety checks implemented in diagnostic systems of many cars to fail. Even though an LED based headlamp may be working properly, a safety check may be misguided by the low power consumption and may erroneously indicate a head light failure.

In the past, part of these problems have been addressed e.g. as follows: JP2008021602A uses a separate heater unit provided to an upper reflector of an LED lamp unit for de-icing the cover glass lens of a headlight. US20120019145A1 arranges infrared LEDs in-between visible LEDs on a common flat heat conductive plate for de-icing. US20080265789A1 follows a similar approach, however, foresees further variants for the shape of the common carrier of the infrared and visible LEDs, and also uses the infrared LEDs to consume an electrical power adjusted to avoid failure of the safety checks performed by the car's diagnostic system.

SUMMARY OF THE INVENTION

It is an object of the present invention to provide a light emitting device that enables deicing and/or defogging of headlight and/or taillight covers while allowing use of LEDs for vehicular headlights and/or taillights. It is a further object of the present invention to provide a corresponding lighting system.

According to a first aspect of the present invention, a light emitting device is provided comprising:

- a body;
- a base portion configured for mounting the light emitting device to a reflector of a headlight or taillight, the base portion being arranged at a first end portion of the body;
- at least one light-emitting diode, abbreviated LED, arranged at or inside of the body;
- at least one infrared light source provided at the body and configured to emit infrared light; and
- a thermal barrier arranged in between the at least one infrared light source and the at least one LED and configured to block at least part of radiation emitted from the at least one infrared light source towards the at least one LED.

According to a second aspect of the present invention, a lighting system is provided comprising:

- a light emitting device according to the first aspect of the invention, and
- the reflector,
- wherein
- the light emitting device is mounted to the reflector via the base portion,
- the reflector is configured to reflect light emitted from the at least one LED at least in a main lighting direction, and
- the at least one infrared light source is configured to emit the infrared light at least in the main lighting direction.

Exemplary embodiments of the first and second aspects of the invention may have one or more of the properties described below.

As mentioned above, according to the first aspect of the present invention, a light emitting device is provided that comprises a body and a base portion. The light emitting device according to the first aspect may in an exemplary embodiment be a lamp. For example, in this exemplary embodiment, the light emitting device may be a lamp for retrofitting a halogen lamp, e.g. a H4 or H7 lamp.

It is to be noted that a retrofit lamp is to be understood as referring to a lamp that can be used (and is compatible) with a conventional socket. A retrofit headlight lamp may thus be understood to refer to a lamp that can be used (and is compatible) with a conventional headlight socket. For example, light-emitting diodes, LEDs, can be made retrofit or retrofitted by being incorporated into a lamp that fits into a conventional socket. For example, one or more LEDs can be incorporated into a filament lamp of existing shape to form a retrofit LED lamp. As mentioned, for example filament lamps suitable for automotive applications are in particular those defined within the ECE Regulations, e.g. in document E/ECE/324/Rev.1/Add.36/Rev.7-E/ECE/TRANS/505/Rev.1/Add.36/Rev.7, which is currently available at https://www.unece.org/fileadmin/DAM/trans/main/wp29/wp29regs/R037r7e.pdf. For example, in particular by incorporating an LED lamp into a H4 or H7 lamp as defined therein forms a retrofit lamp which may serve as basis for embodiments of the present invention. In other words, in an exemplary embodiment, the light emitting device is a retrofit H4 or H7 lamp, in particular for an automotive headlight or taillight.

In an exemplary embodiment, the body may be a hollow body, for example an envelope or a bulb, for example made of glass or of another suitable light transparent material. In this embodiment, the at least one light-emitting diode, the LED, may be arranged inside of the body, whereby for example connections for electrically connecting the at least one LED and for mounting the LED may extend into the body from the base portion. In another exemplary embodiment, the body may form a support structure, e.g. may be essentially plate shaped, and may be of a suitable material (e.g. of metal). In this embodiment, the at least one LED may be arranged at (e.g. mounted to) this support structure. In an exemplary embodiment, the LED may for example be a blue LED with a phosphor layer for converting part of blue light emitted from said blue LED into yellow light for generating white light.

As mentioned, the base portion is configured for mounting the light emitting device to a headlight or taillight, the headlight or taillight being a headlight or taillight for example of a vehicle such as e.g. a car, a motorcycle, a bus, a truck, an ambulance or any different vehicle for transporting people and/or goods. More specifically, the base portion is configured for mounting the light emitting device to a reflector of the headlight or taillight. Thereby, the base portion is arranged at a first end portion of the body, e.g. may be connected to or mounted to said first end portion or may be formed integrally with said first end portion. It is to be noted that in a simple case, the first end portion of the body may for example correspond to one of two opposing end portions of an elongated body structure. In different cases, where a body may have a more complicated structure with multiple identifiable end portions or where a body may have an essentially round structure, the first end portion of the body may correspond to that portion of the body where the body is arranged at/mounted to/connected with the base portion.

In an exemplary embodiment, the at least one light-emitting diode may correspond to an arrangement of plural (at least two) light-emitting diodes. For example, the arrangement may comprise four light-emitting diodes. In an exemplary embodiment, the at least one light-emitting diode may comprise at least one white light-emitting diode which may have a color temperature of for example 6000 K.

According to the invention, the light emitting device comprises at least one infrared light source provided at the body and configured to emit infrared light. In an exemplary embodiment of the invention, the at least one infrared light source comprises at least one light-emitting diode and/or at least one filament. Thereby, in an exemplary embodiment, the light temperature of the at least one infrared light source, in particular of the filament, may be below 1800 K, more particularly below 1500 K. In other words, at least in the latter exemplary embodiment, the infrared light source emits essentially no visible light. Further, a lifetime of such infrared light source, in particular of a filament, is expected to be very long as the lifetime of such filaments is expected to increase with decreasing temperature. In a preferred embodiment, the infrared light source comprises a filter configured to block visible light (e.g. visible light e.g. within a wavelength range from 350 nm to 750 nm). Such filter may for example correspond to a coating which is non-transparent for visible light, e.g. provided on an outer surface of an infrared filament envelope/bulb or on an outer surface of one or more infrared LEDs.

The at least one infrared light source enables a deicing and/or defogging functionality of the light emitting device. In other words, in addition to light emitted from the at least one light-emitting diode (e.g. visible light e.g. within a wavelength range from 350 nm to 750 nm), in operation, the light emitting device may emit also infrared light. Infrared light is absorbed by water better than for example visible light and may thus be advantageously used to efficiently remove ice or dew that may have formed on a headlight or taillight cover.

Thereby, infrared light may be understood in accordance with embodiments of the present invention as light comprising at least one wavelength equal to or larger than 750 nm, e.g. starting at the edge where visible red light turns into invisible infrared light. While water absorbs infrared light within a large wavelength range above 750 nm, with a particularly high absorption in a range between about 2 μm and 100 μm, the absorption starts gradually decreasing at about 20 μm. Thus, in an embodiment of the invention, infrared light is to be understood as comprising at least one wavelength within a range from 750 nm to 1 mm, more particularly within a wavelength range from 800 nm to 1 mm, even more particularly within a wavelength range from 2000 nm to 30 μm.

Thus, according to the invention, the at least one infrared light source is an integral component of the light emitting device, e.g. of a lamp that is mountable to a reflector of a vehicle headlight. By providing the light emitting device, the present invention provides a solution according to which a main light source for a vehicle headlight, i.e. the at least one LED, and the (secondary) infrared light source are provided integrally within a single module. With such integral module, e.g. in form of a retrofit lamp for replacing a conventional halogen lamp such as a H4 or H7 lamp, the present invention provides a simple device that integrates lighting and deicing/defogging functionalities and that can be mounted in a simple way.

In addition, by adding the at least one infrared light source to the light emitting device, the light emitting device has an increased overall power consumption (at least higher than a typical LED power consumption of about 7 W to 20 W). In particular in a case where the light emitting device is used for retrofitting a H4 or H7 lamp, e.g. headlamp, this is useful as the light emitting device can be used for example in cars (or motorcycles) employing a conventional safety check that relies on a higher power consumption of corresponding conventional H4 or H7 lamps. By choosing an appropriate infrared light source, the overall power consumption of the light emitting device can be adjusted to be close to a power consumption value typical for a case where a conventional halogen lamp is used, for example a value of 55 W. In other words, by adding an appropriate infrared light source to the at least one LED, the overall power consumption is sufficient for a conventional safety check to work.

According to an exemplary embodiment of the invention, the at least one infrared light source is arranged at a second end portion of the body opposite to the first end portion of the body. As mentioned above, the body may for example correspond to an envelope or bulb as in the case of an H4 or H7 lamp, and may in this case have an elongated shape with mutually opposing first and second end portions. Similarly, also in the case where the body is a supporting structure for the at least one LED, such supporting structure may have identifiable first and second end portion. As further mentioned above, a body may also comprise a more complex structure. In any case, the second end portion of the body may correspond to an end portion of the body opposing the end portion at which the body is arranged on and/or connected with and/or mounted to and/or formed integrally with the base portion. By providing the at least one infrared light source at the end portion opposing the end portion where the body is for example mounted to the base portion, the at least one infrared light source is positioned such that it does not obstruct usable light emitted from the at least one LED. In other words, positioned in this way, the infrared light source does not (at least not substantially) alter the light emission of the at least one LED. In mounted condition, for example in the case of a light emitting device retrofitting a H4 or H7 halogen lamp, light emitted from the at least one LED is emitted towards a reflector to be reflected into a main lighting direction of a light-emitting system such as a headlight or taillight. By positioning the at least one infrared light source at the second end portion, neither such light emitted from the at least one LED nor the corresponding light reflected from such reflector is blocked by the infrared light source.

According to the invention, the light emitting device further comprises a thermal barrier arranged in between the infrared light source and the at least one LED and configured to block at least part of radiation emitted from the infrared light source towards the at least one LED. For example, a thermal barrier may be a structure formed from a suitable material, e.g. a metal structure or a plastic structure capable of blocking light emitted from the at least one infrared light source. The thermal barrier is arranged at least partially in between the at least one LED (and/or its supporting structure, e.g. its heatsink) and the infrared light source such that at least direct infrared light rays emitted from the infrared light source in a direction towards the at least one LED are blocked and are thus prevented from undesirably heating the at least one LED.

According to an exemplary embodiment of the invention, the light emitting device comprises a reflector arranged in between the at least one infrared light source and the at least one LED and configured to reflect radiation emitted from the infrared light source. The reflector may be provided in addition or alternatively to the thermal barrier in between the at least one LED and the infrared light source. In addition to preventing infrared light being radiated towards the at least one LED and thus undesirably heating the at least one LED, the reflector reflects the infrared light thereby increasing the desired output of the infrared light source. In an exemplary embodiment, said reflector comprises at least one metal mirror. It is noted that a metal mirror may in an exemplary embodiment correspond to a (e.g. polished) metal surface. Typical metals usable for metal mirrors include in particular silver, aluminum or gold. In an exemplary embodiment, said mirror may be formed as a thin layer (e.g. a coating) on a corresponding outer surface of the body facing the infrared light source.

According to an exemplary embodiment of the invention, the second end portion of the body comprises an inwardly curved portion at least partially curved towards (e.g. concavely shaped or hollowed inwardly) the first end portion and/or towards the at least one LED, and wherein the at least one infrared light source is at least partially received by the inwardly curved portion of the second end portion. In other words, the at least one infrared light source is at least partially arranged within a space formed by the inwardly curved portion. For example, if the body corresponds to an envelope or bulb of a H4 or H7 lamp, the portion of this body not to be mounted to the base portion may be formed in this way. This portion may be curved inwardly to provide a recess like structure configured to receive the infrared light source, e.g. an elongated infrared filament. In this way, a particularly compact construction becomes possible where the infrared light source can advantageously be incorporated into and received by the body. In addition, this configuration may enhance stability of the mount of the infrared light source at the body.

According to an exemplary embodiment of the invention, in such case, the reflector is formed at least partially on an outer surface of the inwardly curved portion of the second end portion. For example in this case, the reflector may be formed as a thin metal layer or coating on an outer surface of this inwardly curved portion. In the described case of the body corresponding to an envelope or bulb of a H4 or H7 lamp, this layer may be formed on an outer surface of this envelope or bulb. This construction advantageously helps to increase efficiency and use of the infrared light source as the rounded surface provides an optimum geometry for supporting the reflector to reflect a large portion of infrared light which otherwise would be lost.

In an exemplary embodiment, the infrared light source comprises an envelope housing an infrared filament. In an exemplary embodiment, the reflector is formed at least partially on an outer surface of the envelope adjacent to the inwardly curved portion of the second end portion. In this case, the reflector may be formed as a coating (e.g. a metal coating) on the outer surface of the envelope.

According to an exemplary embodiment of the invention, the at least one LED and the at least one infrared light source are electrically connected in series.

For example, these components may be electrically connected in series in between two electrical pins of a socket of the light emitting device. In other words, when the light emitting device is connected to a power source and operated, a same current may flow through the at least one LED and the at least one infrared light source, while a voltage drop at the at least one LED and at the at least one infrared light source, respectively, is given by the respective resistance. In this way, the at least one infrared light source may act as a current limiting component limiting the (maximum) current that flows through the at least one LED. In this way, the at least one LED is protected against damage in cases where for example current peaks may occur in an automotive power system, for example when an engine is stopped and started again upon use of an automotive start-stop system. The at least one LED may further be protected in a case where the light emitting device is erroneously placed in a system using a higher system voltage as allowed for the particular light emitting device. For example, in case a light emitting device designed for an application in a car (where a typical system voltage is on the order of 12 Volt), is erroneously used with a truck battery (where a typical system voltage is on the order of 24 Volt), the current limiting function of the infrared light source may prevent the at least one LED from damage, at least for a time long enough for the system to shut down before the light emitting device is damaged. Thus, with this configuration the light emitting device may fulfill a requirement that the light emitting device should withstand a voltage of 24 Volt at least for a short time.

In an exemplary embodiment, the light emitting device comprises an arrangement comprising at least two LEDs (for example at least four LEDs), whereby all LEDs of the arrangement are connected in parallel, the arrangement being connected in series with the at least one infrared light source. This embodiment may provide an advantage in that a voltage applied to the LEDs is equal for all LEDs and that the impact of the LEDs to the circuit is minimized. In other words, the nature of the circuit of LEDs and the at least one infrared light source is dominated by the resistor nature of the at least one infrared light source.

In the exemplary embodiments in which the at least one LED and the at least one infrared light source are electrically connected in series, in case the at least one infrared light source comprises at least two infrared light sources, the at least two infrared light sources may be connected all in series or all in parallel. A mixture of series and parallel connection of the infrared light source is possible, e.g. if the at least one infrared light source comprises at least three infrared light sources.

According to an exemplary embodiment of the invention, the light emitting device further comprises a linear regulator connected in series in between the at least one LED and the infrared light source. A linear regulator is an electronics component that may be used to maintain a steady voltage. The resistance of the regulator may vary in accordance with a corresponding load resulting in a constant voltage output. Used in combination with the at least one LED and the at least one infrared light source, such linear regulator can be advantageously used to further ensure that the current flowing through the at least one LED is limited even in case of high voltage and/or high current peaks.

As mentioned above, according to the second aspect of the present invention, a lighting system is provided that comprises a light emitting device in accordance with the first aspect of the present invention. It is to be noted that the lighting system may accordingly comprise a lighting system in accordance with all embodiments of the first aspect of the present invention. This lighting system according to the second aspect further comprises the reflector of the headlight or taillight, wherein the light emitting device is mounted to the reflector via the base portion, the reflector being configured to reflect light emitted from the at least one LED at least in a main lighting direction; wherein the at least one infrared light source is configured to emit the infrared light at least in the main lighting direction.

Thus, as explained above, the base portion of the light emitting device is configured for mounting the light emitting device to the reflector. As also explained above, the reflector serves to reflect and guide light emitted from the at least one LED (i.e. from the main light source) into a main lighting direction. By mounting the at least one infrared light source at the above discussed second end portion of the body, the at least one infrared light source is on the one hand positioned such that it does not obstruct light from the at least one LED and on the other hand is enabled to emit infrared light similarly along said main lighting direction.

According to an exemplary embodiment of the invention, the lighting system further comprises:

a controller configured to control operation of the at least one infrared light source, a first sensor comprising at least one of:

a temperature sensor configured to detect an ambient temperature, and a sensor configured to detect ice or humidity present on an outside surface of a light exit face of the lighting system, and a second sensor configured to measure a voltage applied to the at least one LED, or to the at least one infrared light source, or to the light emitting device;

wherein the controller is configured to control an operation of the at least one infrared light source based on an output of the first sensor or on an output of the second sensor.

Thus, while the at least one infrared light source may be used during operation of the at least one LED, it may be desirable to turn off the at least one infrared light source when not needed to save power (all or one or more infrared light sources in case more than one infrared light source is used). To this end, a controller which may be a component comprising one or more suitable processors being for example integrated into control electronics of a car may be configured to turn on or off the infrared light source based on an output of one or more sensors. As mentioned, suitable sensors include for example a temperature sensor that is configured to detect an ambient temperature, e.g. of a car to which the lighting system (e.g. the headlight or taillight) is mounted. Further, the one or more sensors may include a sensor configured to detect ice and/or humidity present on an outside surface of a light exit face of the lighting system. This may for example be a humidity sensor. Still further, a sensor configured to measure (e.g. monitor) a voltage applied to the at least one light-emitting diode and/or to the at least one infrared light source and/or to the light emitting device is useful. For example, if two infrared light sources (in particular infrared filaments) are used in series with the at least one LED, and if the applied voltage drops under a required limit for the LEDs to function properly, the controller can, based on the output of the sensor measuring the voltage of the infrared light sources and/or the LEDs, switch to use of a bypass of one of the infrared light sources to thus increase the current applied to the at least one LED. Similarly, the controller can switch from a bypassed infrared light source to use of the infrared light source, in case the voltage from the power source gets too high.

It is to be noted that in an exemplary embodiment, the controller is configured to control an operation of the at least one infrared light source (alternatively or in addition to the control based on an output of the sensor(s)) based on a timer. Such timer can be set to allow for the at least one infrared light source to be turned on, e.g. after start of a car, long enough for a safety check to work and to be turned off after the safety check has been passed. In other words, the timer can be set based on an operation of the safety check. This may be useful in terms of power consumption while the same principle can be applied for de-icing and/or removal of dew.

According to an exemplary embodiment of the invention, the lighting system further comprises a cooler configured to cool the at least one LED. Such cooler may be an electrical component suitable for cooling the at least one LED, for example a solid-state electronic component suitable for cooling one or more LED dies. Such cooler may in an exemplary embodiment be in particular a fan configured to direct a stream of cooling air to the at least one LED.

According to an exemplary embodiment of the invention, the cooler is electrically connected in series with the at least one LED. In an exemplary embodiment, the cooler may be connected in series with the at least one LED and the at least one infrared light source. For example, when the light emitting device is mounted to the lighting system, the cooler may be connected in series with one of two pins of a socket of the light emitting device such that at least the cooler and the at least one LED are connected in series. In addition to or alternative to the at least one infrared light source, the cooler may in this configuration help to limit a maximum current for the at least one LED. It is further noted that the addition of the cooler may be useful in that its power consumption may add to the power consumption of the light emitting device when mounted to the lighting system, which may help to bring the overall power closer for example to a value suitable for the safety check to be passed, e.g. to a value of 55 W e.g. in case of a H7 bulb.

The features and example embodiments of the invention described above may equally pertain to the different aspects according to the present invention. In particular, with the disclosure of features relating to the light emitting device according to the first aspect, also corresponding features relating to the lighting system according to the second aspect are disclosed.

It is to be understood that the presentation of embodiments of the invention in this section is merely exemplary and non-limiting.

Other features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not drawn to scale and are merely intended to conceptually illustrate the structures and procedures described herein.

BRIEF DESCRIPTION OF THE DRAWINGS

Examples of the invention will now be described in detail with reference to the accompanying drawing, in which.

DETAILED DESCRIPTION OF THE EMBODIMENTS

Figure 1:
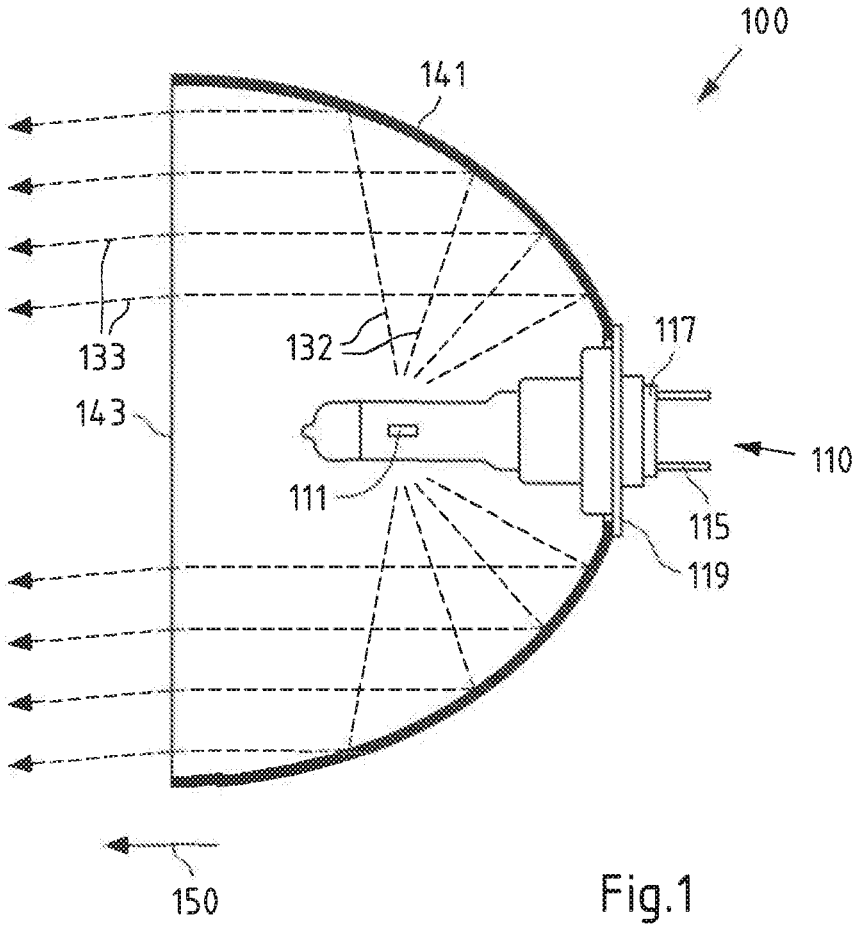
FIG. 1 shows an exemplary cross-sectional view of a lighting system incorporating a halogen lamp.

FIG. 1 shows an exemplary cross-sectional view of a headlight 100 or headlamp 100 with a reflector 141 to which a halogen lamp 110, in the shown case, a H7 lamp 110, is mounted. As illustrated, a main light source 111 of the halogen lamp 110 is thereby placed at or near the focus of reflector 141 such that light (illustrated by light rays, two of which are labeled 132) emitted from said main light source 111 is reflected by the reflector 141 into a main lighting direction 150. Headlight 100 further comprises a cover 143 which may incorporate light guiding capabilities, i.e., which may for example comprise one or more lenses, Fresnel optics, diffusers or prisms. In the shown case, the parallel light rays reflected from the inner reflector surface are bent downwardly by said cover 143. Two of the bent light rays are exemplarily labeled 133.

Figure 2:
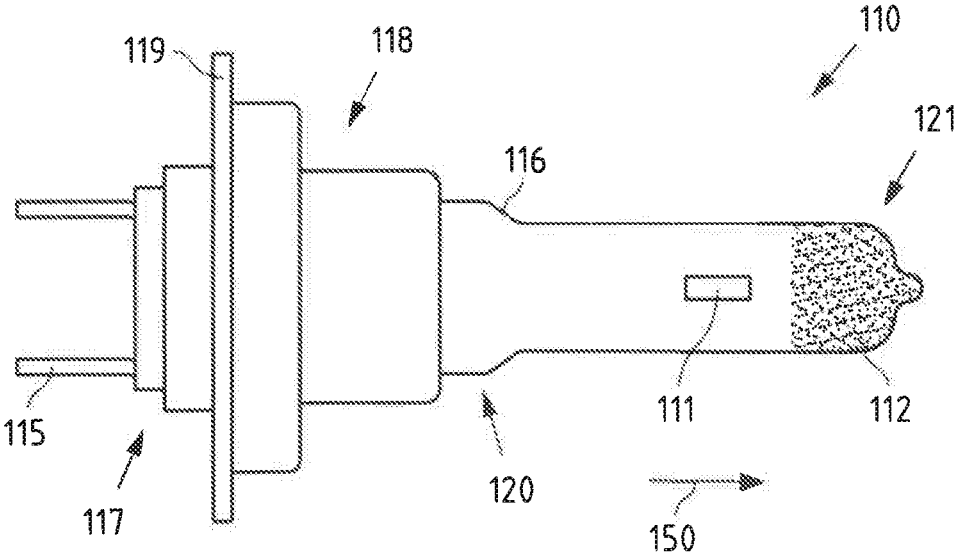
FIG. 2 shows an exemplary cross-sectional view of the halogen lamp of FIG. 1.

FIG. 2 illustrates halogen lamp 110 of FIG. 1 in an enlarged view. As shown, the halogen lamp comprises a body 116 which is mounted to a base portion which in the shown case comprises a plug portion 117, a flange portion 119 and a support portion 118. As can be taken from FIG. 1, with the support portion 118 and the flange portion 119, the base portion is configured for mounting the halogen lamp 110 to headlight 100. FIG. 2 further schematically illustrates the main light source 111, which (as in the case for example of a H4 or H7 lamp) is mounted inside of body 116. Body 116 may have an essentially circular cross-section. The main light source may in the case of a halogen lamp such as a H4 lamp comprise a filament for generating a high beam and a filament for generating a low beam, the filaments being connectable to an electrical power source via pins 115 (only one labeled in the figure). Body 116 may in the shown case correspond to a hollow body such as a bulb or envelope filled with a suitable gas and formed by a suitable transparent material such as quartz glass. Body 116 is mounted to the support portion 118 at a first end portion 120 thereof and comprises an antiglare cap 112 provided at a second end portion 121 thereof to block direct light emitted from the main light source 111 and to allow for the headlight emitting an essentially even light beam without hotspot in the center.

Figure 3:
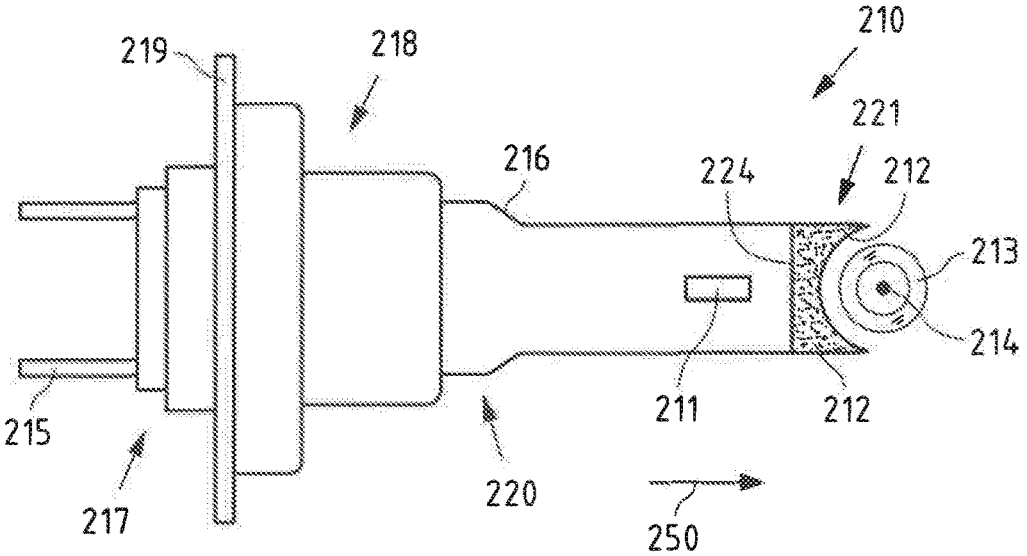
FIG. 3 shows an exemplary cross-sectional view of an embodiment of an inventive light emitting device.

FIG. 3 illustrates a light emitting device 210 in accordance with an embodiment of the first aspect of the present invention. As can be taken from FIG. 3, the light emitting device 210 is essentially based on the halogen lamp 110 illustrated in FIG. 2 and thus corresponds to a retrofit lamp retrofitting for example a H7 halogen lamp. In other words, the light emitting device 210 may replace halogen lamp 110 of FIG. 1 being mounted to reflector 141 to thus form a lighting system according to an embodiment of the second aspect of the present invention.

As shown, the light emitting device 210 comprises a base portion with a plug portion 217 with two pins 215, a flange portion 219 and a support portion 218. Said base portion is configured for mounting the light emitting device 210 to a headlight as for example shown in FIG. 1, and is arranged at a first end portion 220 of a body 216 of light emitting device 210. In other words, body 216 is mounted to the base portion at its first end portion 220. In another example, body 216 may be connected indirectly to the base portion or may be integrally formed with the base portion.

The shown body 216 is an essentially plate like flat member of a suitable material such as a suitable plastic or metal material. The shown main light source 211 schematically shows the at least one LED which is arranged on a front surface of body 216. While the schematic illustration shows a single light source 211, more than one LED may be positioned at or around the position of main light source 211. For example, three or four LEDs may be positioned along the position of main light source 211. While not visible in the figure, on a surface of body 216 opposing the visible front surface, further one or more LEDs, e.g. three or four LEDs, e.g. on a position corresponding to the position indicated by main light source 211, may be provided. It is noted that in an alternative embodiment not illustrated, body 216 may essentially correspond to body 116 of FIG. 2, i.e. may correspond to a bulb or envelope for example made of glass or another suitable transparent material. In this case, the main light source 211, i.e. the at least one LED, may be provided inside of body 216. In different embodiments, body 216 may have a different shape with a different cross-section but may nevertheless be suitable to support the at least one LED. The main light source 211 (the at least one LED) may correspond to one LED or to an array of plural LEDs and is provided at a position inside of body 216 such that in mounted condition of the light emitting device 210 in a reflector (e.g. reflector 141), the main light source 211 is placed at or close to a focus of the reflector.

As further shown in FIG. 3, an infrared light source, in the shown case an infrared filament 214 housed by a filament bulb 213, is arranged at a second end portion 221 of body 216, which second end portion 221 is opposite to the first end portion 220 of body 216. The infrared light source, i.e. the shown filament, is mounted to body 216 via two wires which extend from the infrared filament 214 onto respective surfaces (the shown front surface and the non-visible surface opposing the front surface) of body 216. These wires serve for holding the infrared filament at body 216 and for electrically connecting the infrared filament. An illustration of the wires is omitted to keep the figure concise. It is noted that the particular way of mounting the infrared filament to body 216 is not an essential feature and that multiple ways of mounting the infrared filament to body 216 are apparent for a person skilled in the art.

It is noted that the figures illustrate use of a single infrared filament with corresponding filament bulb for simplicity of the illustration. In accordance with embodiments of all aspects of the invention, one or more infrared light sources such as one or more infrared filaments with corresponding bulbs and/or one or more infrared LEDs may be comprised by the light emitting device and/or by the lighting system.

In the shown example, the infrared light source is an infrared filament housed by a filament bulb 213. The infrared light source is provided at body 216 via said filament bulb 213, which is mounted to body 216 in a convenient manner not illustrated in the figure. For example, a suitable holder (not shown), made for example from a metal or a heat resistant plastic material, can be provided in a way that one of its sides is attached to the filament bulb 213 and that another one of its sides is attached to the second end portion 221 of body 216. As can be taken from the figure, being mounted in this way at the second end portion 221, infrared light emitted from the infrared filament 214 is emitted essentially along the main lighting direction 250 of a lighting system (for example a lighting system part of which is illustrated in FIG. 1) to which the light emitting device 210 is mounted.

In order to protect the main light source 211, i.e. the at least one LED, from heat radiation emitted from infrared filament 214, a thermal barrier 224 is arranged in between the infrared filament 214 and the at least one LED 211, which is configured to block at least part of radiation emitted from the infrared filament 214 towards the at least one LED 211. This thermal barrier or isolator may be a component like a thin metal plate configured to block infrared radiation.

Further, a reflector 212 is arranged in between the infrared filament 214 and the at least one LED 211 and is configured to reflect radiation, emitted from the infrared filament 214, essentially into the main lighting direction 250. As can be taken from FIG. 3, in the shown case, said reflector 212 corresponds to a sheet or coating formed at least partially on an outer surface of an inwardly curved portion formed within the second end portion 221 which is curved towards the first end portion 220 and towards the at least one LED 211. The reflector 212 may for example be a metal sheet or metal coating such as a silver, gold or aluminum coating. In an alternative exemplary embodiment (not shown), the reflector 212 may be formed at least partially on an outer surface of the filament bulb 213 adjacent to the inwardly curved surface of the second end portion 221. Such reflector may similarly be formed as a coating (e.g. a metal coating) on the outer surface of the filament bulb 213. Referring back to FIG. 3, as shown, the infrared light source, in particular the filament bulb 213 is at least partially received by the inwardly curved portion of the second end portion 221. In other words, the infrared light source is thus arranged within a space formed by the inwardly curved portion making the construction compact and robust. As mentioned above, the infrared light source may in addition or alternatively comprise at least one LED configured to emit infrared light, whereby infrared light corresponds to electromagnetic radiation comprising at least one wavelength equal to or larger than 750 nm.

Figure 4:
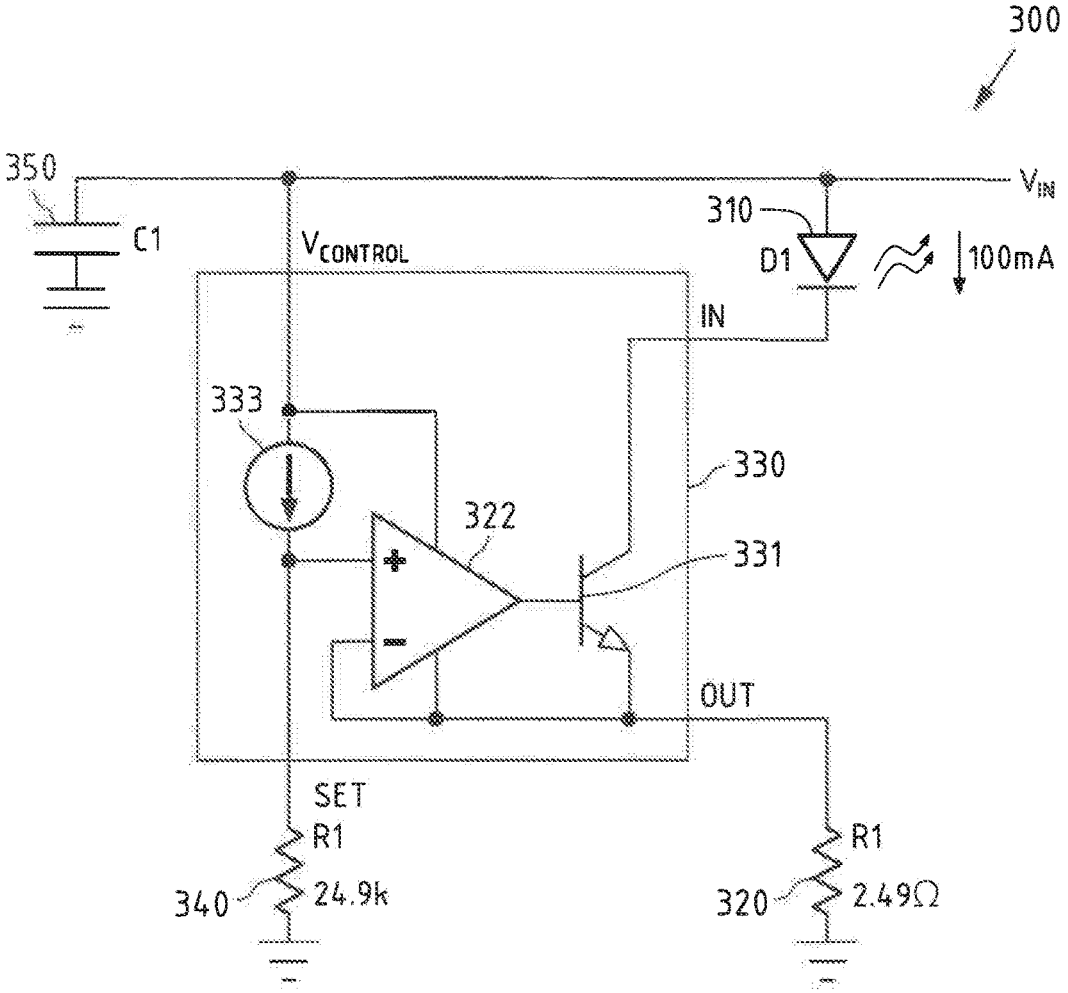
FIG. 4 shows an exemplary circuit diagram of an embodiment of connecting the at least one LED and the at least one infrared light source in series.

The at least one LED and the infrared light source may be electrically connected in series for example in between pins 215 (only one labeled in FIG. 3) of plug portion 217. As explained above, thereby, the infrared light source may serve as current limiting device to protect the at least one LED against current peaks which may arise for example in a case an engine of a vehicle to which the light emitting device is mounted is started. As further mentioned above, a linear regulator may be provided connected in series between the at least one LED and the infrared light source in order to further reduce the risk of current peaks acting on the at least one LED. FIG. 4 shows an example of a system 300 with a suitable linear regulator 330. Linear regulator 330 incorporates a current source 333, an operational amplifier 322 and a transistor 331. In the shown circuit diagram, reference 310 represents the at least one LED 211 of FIG. 3 and reference 320 represents the (at least one) infrared filament 214 of FIG. 3 connected in series to linear regulator 330, which in turn is connected at its two different further connections to ground via capacitor 350 and resistor 340. It turned out, that use of linear regulator 330 connected in this way enables the at least one LED to withstand cases in which peaks arise with voltages larger than 24 Volts.

Thus, as explained above, by incorporating the infrared light source, e.g. infrared filament 214 housed by bulb 213 into a light emitting device, it becomes possible to enable deicing and/or defogging of covers of headlights and/or taillights to which said light emitting device is mounted. At the same time, a compact and robust construction is achieved which can be retrofitted suitably for automotive applications. In addition, the arrangement can be configured to achieve a suitable power consumption that allows to use the light emitting device in existing systems with conventional safety checks.

The following enumerated paragraphs provide additional non-limiting aspects of the disclosure.

1. A light emitting device comprising:
   - a body;
   - a base portion configured for mounting the light emitting device to a reflector of a headlight or taillight, the base portion being arranged at a first end portion of the body;
   - at least one light-emitting diode, abbreviated LED, arranged at or inside of the body;
   - at least one infrared light source provided at the body and configured to emit infrared light; and
   - a thermal barrier arranged in between the at least one infrared light source and the at least one LED and configured to block at least part of radiation emitted from the at least one infrared light source towards the at least one LED.

2. The light emitting device according to clause 1, wherein the at least one infrared light source is arranged at a second end portion of the body opposite to the first end portion of the body.

3. The light emitting device according to any one of clauses 1 and 2, further comprising: a reflector arranged in between the at least one infrared light source and the at least one LED and configured to reflect radiation emitted from the at least one infrared light source.

4. The light emitting device according to clause 2, wherein the second end portion of the body comprises an inwardly curved portion at least partially curved towards the first end portion and towards the at least one LED, and wherein the at least one infrared light source is at least partially received by the inwardly curved portion of the second end portion.

5. The light emitting device according to clause 4, wherein a reflector is formed at least partially on an outer surface of the inwardly curved portion of the second end portion.

6. The light emitting device according to any one of clauses 1 and 2, wherein the at least one infrared light source comprises at least one light-emitting diode or at least one filament.

7. The light emitting device according to any one of clauses 1 and 2, wherein the infrared light comprises at least one wavelength equal to or larger than 750 nm.

8. The light emitting device according to any one of clauses 1 and 2, wherein the at least one LED and the at least one infrared light source are electrically connected in series.

9. The light emitting device according to clause 8, further comprising a linear regulator connected in series in between the at least one LED and the at least one infrared light source.

10. A lighting system comprising:

a light emitting device according to any one of clauses 1 and 2, and a reflector, wherein the light emitting device is mounted to the reflector via the base portion, the reflector is configured to reflect light emitted from the at least one LED at least in a main lighting direction, and the at least one infrared light source is configured to emit the infrared light at least in the main lighting direction.

11. The lighting system according to clause 10, comprising:

a controller configured to control operation of the at least one infrared light source, a first sensor comprising at least one of:

a temperature sensor configured to detect an ambient temperature, and a sensor configured to detect ice or humidity present on an outside surface of a light exit face of the lighting system, and a second sensor configured to measure a voltage applied to the at least one LED, or to the at least one infrared light source, or to the light emitting device;

wherein the controller is configured to control an operation of the at least one infrared light source based on an output of the first sensor or on an output of the second sensor.

12. The lighting system according to any one of clauses 10 and 11, comprising a cooler configured to cool the at least one LED.

13. The lighting system according to clause 12, wherein the cooler is electrically connected in series with the at least one LED.

TABLE 1

| LIST OF REFERENCE SIGNS: | |
|---|---|
| 100 | headlight or headlamp |
| 110 | halogen lamp |
| 111 | main light source of halogen lamp |
| 112 | antiglare cap of halogen lamp |
| 115 | electrical pins of halogen lamp |
| 116 | body of halogen lamp |
| 117 | plug portion of base portion of halogen lamp |
| 118 | support portion of base portion of halogen lamp |
| 119 | flange portion of base portion of halogen lamp |
| 120 | first end portion of body of halogen lamp |
| 121 | second end portion of body of halogen lamp |
| 132 | light rays to reflector |
| 133 | light rays after passing cover |
| 141 | reflector |
| 143 | cover of headlight |
| 150 | main light direction of halogen headlamp |
| 210 | inventive light emitting device |
| 211 | main light source |
| 212 | reflector |
| 213 | filament bulb |
| 214 | infrared filament |
| 215 | electrical pins |
| 216 | body |
| 217 | plug portion of base portion |
| 218 | support portion of base portion |
| 219 | flange portion of base portion |
| 220 | first end portion of body |
| 221 | second end portion of body |
| 224 | thermal barrier |
| 250 | main lighting direction |
| 300 | system with linear regulator |
| 310 | LED |
| 320 | infrared filament as resistor |
| 322 | operational amplifier |
| 330 | linear regulator |
| 331 | transistor |
| 333 | current source |
| 340 | resistor |
| 350 | capacitor |

This disclosure is illustrative and not limiting. Further modifications will be apparent to one skilled in the art in light of this disclosure and are intended to fall within the scope of the appended claims.

The invention claimed is:

1. A light emitting device comprising:

an elongated body having oppositely disposed first and second end portions that define a longitudinal axis;

a base portion configured for mounting the light emitting device to a reflector of a headlight or taillight, the base portion being attached to the first end portion of the body;

at least one light-emitting diode, abbreviated LED, arranged at or inside an intermediate portion of the body between the first and second end portions;

at least one infrared light source attached to the second end portion of the body, the at least one infrared light source being configured to emit infrared light; and an infrared reflector positioned along the longitudinal axis at the second end portion of the body, the infrared reflector being arranged so as to act as a thermal barrier arranged in between the at least one infrared light source and the at least one LED, the infrared reflector being configured to block at least a portion of infrared light emitted the at least one infrared light source that propagates towards the at least one LED.

2. The light emitting device according to claim 1, wherein the second end portion of the body comprises an inwardly curved portion at least partially curved towards the first end portion and towards the at least one LED, the infrared reflector is formed on at least a portion of the inwardly curved portion, and the at least one infrared light source is at least partially received within the inwardly curved portion of the second end portion.

3. The light emitting device according to claim 1, wherein the at least one infrared light source comprises at least one light-emitting diode or at least one filament.

4. The light emitting device according to claim 1, wherein the infrared light comprises at least one wavelength equal to or larger than 750 nm.

5. The light emitting device according to claim 1, wherein the at least one LED and the at least one infrared light source are electrically connected in series.

6. The light emitting device according to claim 5, further comprising a linear regulator connected in series in between the at least one LED and the at least one infrared light source.

7. A lighting system comprising:

a light emitting device according to claim 1, and a visible reflector, wherein the light emitting device is mounted to the visible reflector via the base portion, the visible reflector is configured to reflect at least a portion of light emitted from the at least one LED at least in a main lighting direction, the main lighting direction being substantially parallel to the longitudinal axis, and the at least one infrared light source is configured to emit at least a portion of the infrared light at least in the main lighting direction.

8. The lighting system according to claim 7, comprising:

a controller configured to control operation of the at least one infrared light source, a first sensor comprising at least one of:

a temperature sensor configured to detect an ambient temperature, and a sensor configured to detect ice or humidity present on an outside surface of a light exit face of the lighting system, and a second sensor configured to measure a voltage applied to the at least one LED, or to the at least one infrared light source, or to the light emitting device;

wherein the controller is configured to control an operation of the at least one infrared light source based on an output of the first sensor or on an output of the second sensor.

9. The lighting system according to claim 7, comprising a cooler configured to cool the at least one LED.

10. The lighting system according to claim 9, wherein the cooler is electrically connected in series with the at least one LED.

11. The lighting system according to claim 7, wherein the visible reflector is configured to reflect light emitted from an H4 or H7 halogen lamp mounted to the visible reflector, and the light emitting device is configured as a replacement for an H4 or H7 halogen lamp.

12. The lighting emitting device according to claim 1, the infrared reflector being concave.

13. The lighting emitting device according to claim 1, the infrared reflector being arranged so as to (i) redirect at least a portion of infrared light emitted by the at least one infrared light source to propagate away from the second end portion of the body along the longitudinal axis and (ii) block propagation of light emitted by the at least one LED away from the second end portion of the body along the longitudinal axis.

14. The lighting emitting device according to claim 1, the infrared reflector being concave and arranged so as to (i) redirect at least a portion of infrared light emitted by the at least one infrared light source to propagate away from the second end portion of the body along the longitudinal axis and (ii) block propagation of light emitted by the at least one LED away from the second end portion of the body along the longitudinal axis.

15. The lighting emitting device according to claim 1, wherein the light emitting device is configured as a replacement for an H4 or H7 halogen lamp.

* * * * *